United States Patent [19]

Person

[11] 4,454,695

[45] Jun. 19, 1984

[54] COMPOSITE FLOOR SYSTEM

[76] Inventor: Joel I. Person, 28 N. Third St., Brooklyn, N.Y. 11211

[21] Appl. No.: 342,467

[22] Filed: Jan. 25, 1982

[51] Int. Cl.[3] ..... E04B 1/16; E04B 5/19

[52] U.S. Cl. ..... 52/334; 52/338; 52/694

[58] Field of Search ..... 52/719, 334, 338, 378, 52/690, 691, 692, 693, 694, 695, 732, 333, 327, 328, 335, 339, 332

[56] References Cited

U.S. PATENT DOCUMENTS 3,362,121 1/1968 Weber ..... 52/334

*Primary Examiner*—Alfred C. Perham

[57] ABSTRACT

A composite floor system includes a plurality of joists, each having a top and bottom chord and a web in the space between the chords. The top chord includes a pair of angle bars, each having a vertical leg of differing heights and a horizontal leg. The top of the web extends between the vertical legs of the chord to a point between or level with the top of the larger vertical leg of the angle bars. Decking is supported by the horizontal legs of the top chord of adjacent joists and a concrete slab poured on the decking and between the vertical legs of the top chord to provide bonding between the concrete slab, top chord and web.

5 Claims, 4 Drawing Figures

COMPOSITE FLOOR SYSTEM

DESCRIPTION OF THE INVENTION

Figure 1:
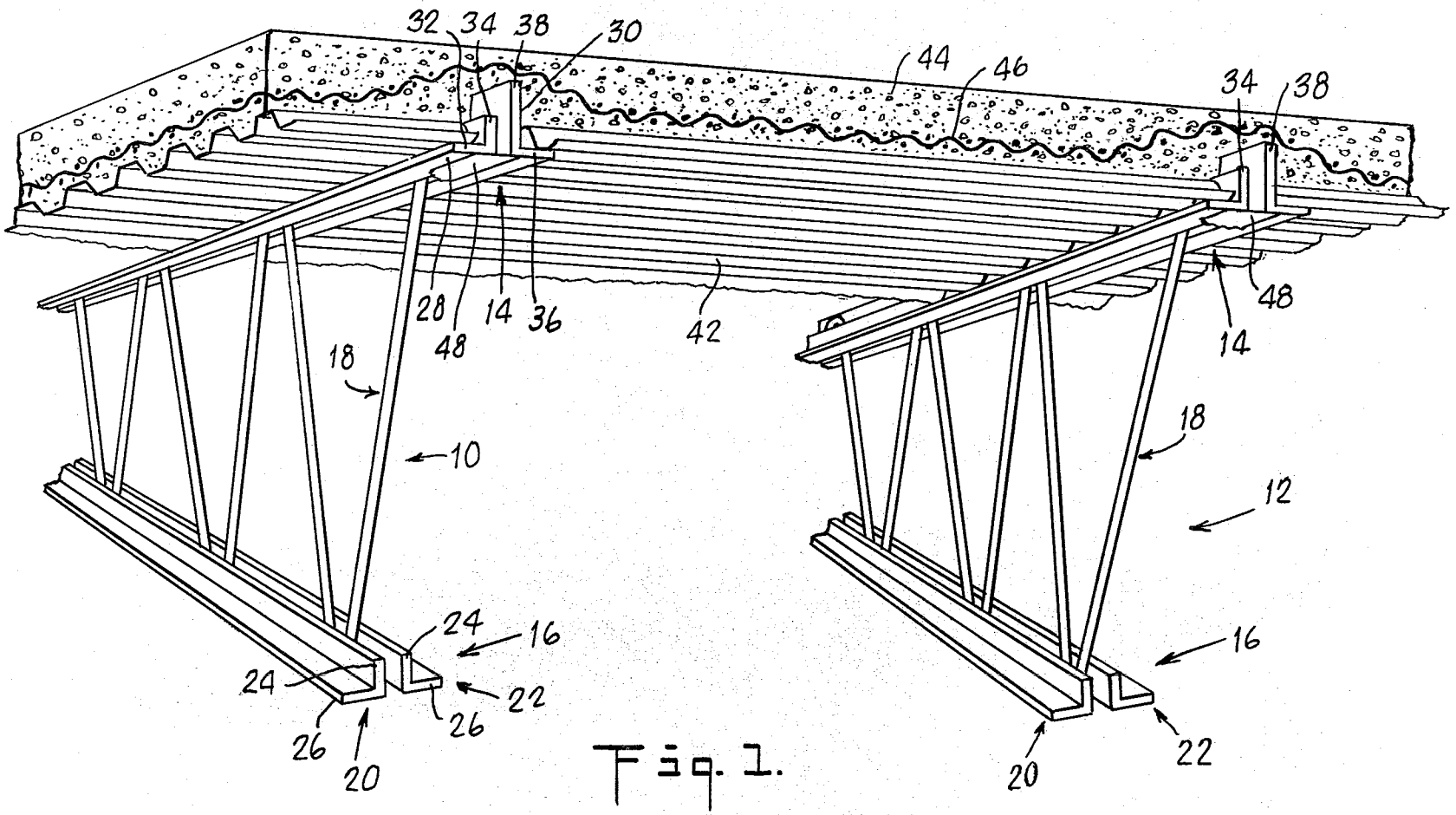
Figure 3:
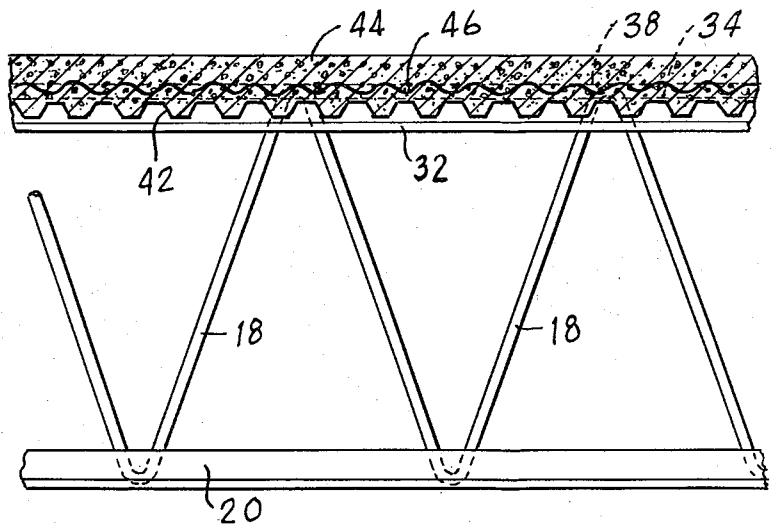
Figure 2:
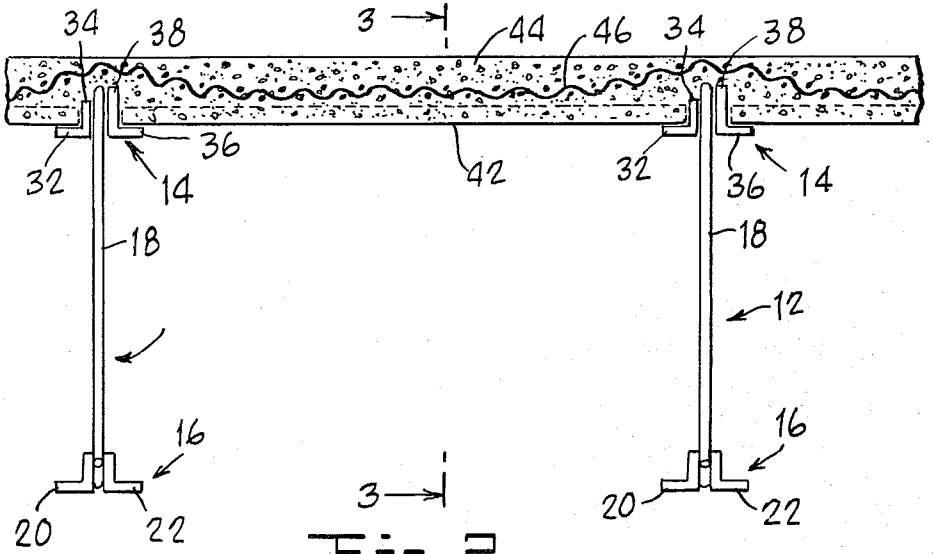
Figure 4:
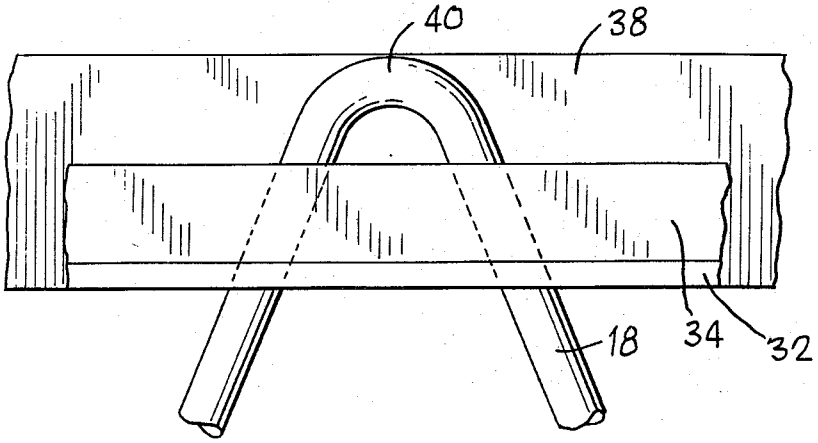

This invention relates to a composite floor construction, and more particularly to a composite open-web steel joist and concrete floor construction for use in the construction of buildings.

In the past, floor construction has used open-web steel joists placed in position spanning structural supports and a concrete slab poured on decking supported by the joists. Generally, an open-web steel joist is a joist in the form of a truss having horizontal top and bottom chords joined by a web comprising tension and compression members triangulating the space between the top and bottom chords.

While the chords may be of many shapes, typically, the top and bottom chords each comprise a pair of steel angle bars, the top chord angle bars being arranged with one leg of each bar extending horizontally outward at the top of the truss, and the other leg of each bar extending downwardly on opposite sides of the web. The bottom chord angle bars are arranged with one leg of each bottom chord angle bar extending horizontally laterally outward at the bottom of the truss, and the other leg of each bottom chord angle bar extending vertically upward on the opposite sides of the web. Decking for supporting the concrete slab is laid on and fastened to the horizontal leg of the top chord angle bars at the top of the joist, and a concrete slab poured on the decking. In this typical construction, there is no structural integration of the concrete slab and joist since there is no anchoring of the concrete slab to the joists, and the slab and joists function as separate entities with the slab constituting dead load on the joists without contributing materially to the strength of the overall structure.

In another construction, the upper ends of the web members project upwardly above the upper horizontal legs of the top chord angle bar for anchorage in the concrete slab to form a composite slab and joist construction in which the slab may, to some extent, become a compression member sharing part of the load. It has been found that this type of construction does not obtain the full potential of a composite slab and joist construction, and has certain disadvantages, for example, the effective anchorage is between the slab and the upper ends of the web members so that transfer of stress between the joists and the slab occurs only at the upper ends of the web members. Furthermore, the slab is necessarily placed above the level of the supporting structure for the joists.

In addition, the decking is formed with slots to enable the web member to protrude into the concrete forming the composite section. One problem in this method is that the slots must be exactly aligned along the length of the building and the joist must also be perfectly aligned. If the slots are not perfectly aligned as the material is placed as construction proceeds, the offset between the slots increases.

One attempt to remedy the problems associated with composite floor constructions is disclosed in U.S. Pat. No. 3,362,121, which describes an open-web steel joist in the form of a truss having a web, a top chord and a bottom chord. The top chord comprises a pair of steel angle bars arranged with one leg of each of the bars extending horizontally outward from a position on the truss below the top of the truss, and the other leg of each bar extending upwardly to the same height on opposite sides of the web and terminating below the top of the web. Decking is laid on the horizontal legs of the top chord, and concrete is poured on the decking to embed the vertical legs of the top chord angle bars and the upper ends of the web in the concrete slab to create a composite floor structure.

In both of these constructions, the top chord is below the top of the web member. This construction is weaker in design than the standard joist construction wherein the top of the top chord is aligned with the top of the web. Accordingly, these constructions require heavier members.

Accordingly, an object of this invention is to provide an improved composite floor system which is easy and fast to erect, economical, and which provides improved load carrying capacity.

Still further, it is an object of the invention to provide a composite floor system using a joist in which the upper chord of the joist insures composite action with the concrete deck with a high safety margin.

Still further, it is an object of the invention to provide a composite floor system having less deflection, bounce, vibration and sound transmission as compared with prior floor systems.

It is still another object of the invention to provide a composite floor system having increased lateral diaphragm action.

In accordance with the invention, a joist used in forming a composite concrete floor system comprises a truss which has a top chord, a bottom chord and a web, including tension and compression members in the space between the top and bottom chords secured to the top and bottom chords. The top chord has a pair of metal bars, each having an angle shape in cross section and each having a vertical leg and a horizontal leg. The vertical leg of the first bar extends to a height above the vertical leg of the second bar, and the top of the web extends to a point below the top of the vertical leg of the second metal bar. The vertical legs of the top chord are spaced from one another to permit concrete when poured, to form the composite floor system, to flow between the vertical legs. This joist construction permits internal bonding between the concrete slab and joist.

In accordance with another aspect of the invention, a composite floor system comprises a plurality of metal joists, the joists being in the form of an open-web truss having a top chord and a bottom chord and a web comprising tension and compression members in the space between the top and the bottom chords. The top chord includes first and second metal bars each of angle shape in cross section, and each having a vertical leg and a horizontal leg. The vertical leg of the first bar extends to a height above the vertical leg of the second bar, and the top of the web extends to a point above the top of the vertical leg of the second metal bar and below the top of the leg of the first metal bar. The vertical legs of the chords are spaced from one another by the width of the web which is held between them. Decking material is supported between the horizontal legs of the top chords of adjacent trusses, and a concrete slab is formed over the top of the decking and truss so that the top chord and the top of the web become embedded in the slab, and the concrete, when poured, flows between the inner faces of the vertical legs of the top chord to provide strong interlocking between the concrete slab,

[illegible] surfaces of the provided, [illegible] metal bars, to close [illegible] to be encased [illegible]

[illegible] horizontal legs of the bars [illegible] prevent concrete from [illegible] tween the vertical legs.

These and other [illegible] will [illegible]

These vertical legs [illegible] concrete from [illegible] of the [illegible] to close [illegible] tween the horizontal legs of the [illegible] metal bars, to close the horizontal legs of the [illegible] chord to prevent the horizontal legs of the [illegible] chord metal bars, to close the horizontal legs of the [illegible] space between the top chord and the lower surfaces of the horizontal legs of the [illegible] between the top chord and web. Means are provided, [illegible] which project between the top chord and web, to close the horizontal legs of the [illegible] decking.

second bar, the top of the web extending into the space between the vertical legs of the first and second bars to a point between the top of the vertical leg of the first bar and the top of the vertical leg of the second bar, metal decking material supported between the horizontal legs of the top chords of adjacent joists, a concrete slab formed over the metal decking and the top of the joist to a height above the top of the vertical legs of the first and second bars so that the top chord and the top of the web become embedded in the concrete slab, the concrete slab extending into the space between the inner faces of the vertical legs of the top chord to provide strong interlocking between the concrete slab, top chord and web, and means projected between the lower surfaces of the horizontal legs of the first and second bars for closing the space between the vertical legs of the bars to prevent concrete from leaking out from between the vertical legs of said bars.

4. The composite concrete floor system of claim 3, wherein the top of the web is aligned with the top of vertical leg of the first metal bar of the top chord.

5. The composite concrete floor system of claim 3 further including reinforcing means positioned within the concrete slab to reinforce said slab.

* * * * *